US009174115B2

(12) United States Patent
Vaughan

(10) Patent No.: US 9,174,115 B2
(45) Date of Patent: Nov. 3, 2015

(54) CONVERTIBLE ITEM FOR FOLDING INTO A PLAY FIELD

(76) Inventor: Michael Lee Vaughan, Santa Monica, CA (US)

( * ) Notice: Subject to any disclaimer, the term of this patent is extended or adjusted under 35 U.S.C. 154(b) by 318 days.

(21) Appl. No.: 13/434,307

(22) Filed: Mar. 29, 2012

(65) Prior Publication Data

US 2012/0252304 A1 Oct. 4, 2012

Related U.S. Application Data

(60) Provisional application No. 61/469,029, filed on Mar. 29, 2011.

(51) Int. Cl.

| | |
|---|---|
| ***A63H 33/00*** | (2006.01) |
| ***A63H 33/16*** | (2006.01) |
| ***A63F 3/00*** | (2006.01) |
| *A63F 9/00* | (2006.01) |

(52) U.S. Cl.

CPC ..... *A63F 3/0023* (2013.01); *A63H 33/00* (2013.01); *A63H 33/16* (2013.01); *A63F 3/00041* (2013.01); *A63F 2003/00246* (2013.01); *A63F 2003/00299* (2013.01); *A63F 2009/0049* (2013.01)

(58) Field of Classification Search

CPC ..... A63H 33/00; A63H 33/16; A63H 33/38; A63F 3/0023; A63F 3/00028; A63F 7/06; A63F 7/0616; B65D 81/00; B65D 81/36; B42F 7/06; B42F 7/02

USPC ..... 446/71, 80, 147, 148, 487, 488; 273/285, 108.5

See application file for complete search history.

(56) References Cited

U.S. PATENT DOCUMENTS

| | | | | | |
|---|---|---|---|---|---|
| 1,969,768 | A * | 8/1934 | Robert | G09F 1/04 | 229/92.1 |
| 2,152,882 | A * | 4/1939 | Lester | A63F 7/0668 | 273/108.5 |
| 2,618,887 | A * | 11/1952 | Frankenstein | B65D 81/368 | 229/167 |
| 3,033,570 | A * | 5/1962 | Mathes | A63F 7/0017 | 273/120 R |
| 3,685,170 | A * | 8/1972 | Fairleigh | G09B 1/08 | 273/239 |
| 5,836,507 | A * | 11/1998 | Mueller | B42F 7/02 | 229/67.1 |
| 5,913,540 | A * | 6/1999 | Ong | B42F 7/06 | 281/31 |
| 6,286,752 | B1 * | 9/2001 | Heyer | B42F 7/02 | 229/67.1 |
| 6,350,174 | B1 * | 2/2002 | Halford | A63H 18/028 | 446/444 |
| 6,623,367 | B1 * | 9/2003 | Labelson | A63C 19/10 | 472/89 |
| 2005/0120291 | A1 * | 6/2005 | Guilfoyle | G06Q 30/02 | 715/201 |
| 2007/0057463 | A1 * | 3/2007 | Del Rincon | A63F 3/00 | 273/285 |
| 2007/0085327 | A1 * | 4/2007 | Russo | B42D 9/00 | 281/21.1 |

FOREIGN PATENT DOCUMENTS

| | | | | |
|---|---|---|---|---|
| GB | 2359296 A * | 8/2001 | ..... | A63B 63/004 |

* cited by examiner

*Primary Examiner* — Gene Kim

*Assistant Examiner* — Alyssa Hylinski

(74) *Attorney, Agent, or Firm* — Risso & Associates

(57) ABSTRACT

Described is a convertible item that is portable and that can be easily folded into a playing field through the use of one or more pop-up elements. For example, the convertible item is a substantially flat item that can transition between a first state, in which it is substantially flat, to a second state, in which the pop-up element is affixed in an upright position. In the second state, the convertible item operates as a playing field to allow users to play on its surface. For example, the playing field includes goals (in a soccer or hockey aspect) or can be formed to include a ramp (in a toy skateboard aspect). The convertible item is any suitably flat item, such as a folder for papers, or a greeting card. Thus, it can transition between a folder or card, to a playing field.

4 Claims, 19 Drawing Sheets

100

CONVERTIBLE ITEM FOR FOLDING INTO A PLAY FIELD

PRIORITY CLAIM

This is a non-provisional application of U.S. Provisional Application No. 61/469,029, entitled, "Paper for Folding Into a Ramp," filed on Mar. 29, 2011.

BACKGROUND OF THE INVENTION (1) Field of Invention

The present invention relates to a toy playing field and, more particularly, to a convertible item that can be convertibly folded into a playing field, such as a soccer field, hockey field, football field, and skateboard ramp.

(2) Description of Related Art

In sports, such as soccer, football, and hockey, the sporting events are typically played on a playing field. For children, the playing fields are often mimicked to allow for indoor and space convenient play. Thus, toy playing fields have been conceived that allow users to set up and play miniature toy sporting events. For example, foosball is a common sport in which user's play the game of table soccer on a miniature playing field.

As another example, some individuals play paper football. "Paper football (also called FIKI Football, Finger football, Chinese football, Biren football or Flick football) refers to a table-top game, loosely based on American football, in which a sheet of paper folded into a small triangle is slid back and forth across a table top by two opponents. This game is widely practiced, generally by boys of upper primary, middle school & high school age in the United States, as an informal recreation." See Wikipedia, "Paper Football." During game play, the players flick the paper football at the opponent's hands or raised fingers. Thus, game play in this aspect is largely limited to an imaginary playing field. While some actual miniature playing fields have been conceived, they are dedicated items that are preformed and bulky. Thus, aside from the imaginary playing fields, preformed items are difficult to transport and do not allow for multi-functionality.

In the skateboard realm, the playing field takes the shape of toy ramps. Such toy ramps have long been known in the art. However, as was the case above, the toy ramps are typically pre-formed and sold as hard, plastic ramps for use with a toy skateboard or bicycle. Again, the toy ramps are bulky and do not allow for easy transportation.

Thus, a continuing need exists for a convertible item that is portable and that can be easily folded into a playing field.

SUMMARY OF INVENTION

The present invention is directed to a convertible item that is portable and that can be easily folded into a playing field through the use of one or more pop-up elements. For example, the convertible item is a substantially flat item that can transition between a first state, in which it is substantially flat, to a second state, in which the pop-up element is affixed in an upright position. In the second state, the convertible item operates as a playing field to allow users to play on its surface. For example, the playing field includes goals (in a soccer or hockey aspect) or can be formed to include a ramp (in a toy skateboard aspect). The convertible item is any suitably flat item, such as a folder for papers, or a greeting card. Thus, the convertible item can transition between a children's folder or greeting card, to a playing field that includes goals or ramps (or any other suitable pop-up element).

In another aspect, the substantially flat item includes a back panel with a first half and a second half, with a pop-up element extending from each of the first and second halves.

In one aspect, each pop-up element is ramp portion that can be positioned flat in a first state and folded into a ramp in a second state.

In yet another aspect, each pop-up element is goal portion that can be positioned flat in a first state and folded into a goal in a second state.

Additionally, each goal portion includes at least one flap, tab, fold-line and slit to allow the goal portion to fold from being substantially flat in the first state into the second state, such that when in the second state, the goal portion is affixed into an upright position.

In another aspect, each goal portion includes: a face with a goal hole cut-out of the face, wherein the face extends from the back panel and is separated from the back panel by a face fold-line; a back support and two side supports, wherein the back support and side supports are flaps that extend from the face and are separated from the face by a back fold-line and side, fold-lines, respectively; wherein each of the side supports are connected with the face via the side, fold-lines, while physically cut from the back panel along a side cut-line; and wherein the side supports include side-support tabs and the back support includes back-support slits formed to accommodate the side-support tabs therethrough.

In yet another aspect, the back panel includes indicia printed thereon to simulate a playing field. The indicia is printed to simulate a playing field selected from a group consisting of a soccer field, a hockey field, and a skateboard ramp.

Additionally, the substantially flat item includes a pocket formed on each of the first and second halves, such that when in the first state, the convertible item is foldable into a folder.

In another aspect, the substantially flat item is a greeting card such that when in the first state, the convertible item is foldable as a greeting card.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where:

FIG. 3 is an illustration showing goal portions of the folder as being folded in;

DETAILED DESCRIPTION

Figure 1:
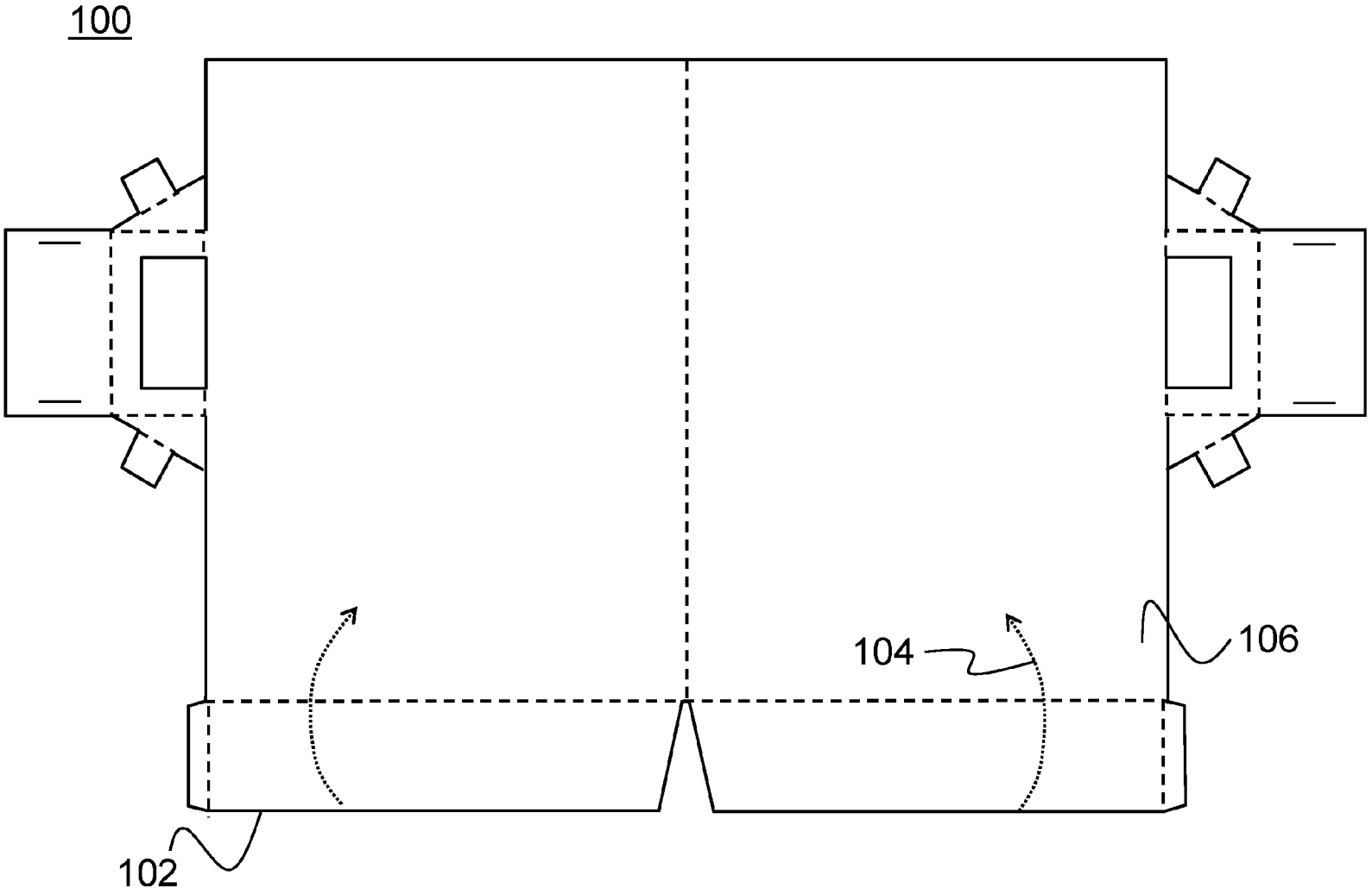
FIG. 1 is a die-line illustration of the shape, perforations, and cut-outs that collectively form a convertible item (e.g., children's folder) that can be folded into a playing field, and further depicting a bottom portion of the shape as being folded up to form pockets of a folder.

The present invention relates to a toy playing field and, more particularly, to a convertible item (e.g., children's folder and greeting card) that can be convertibly folded into a playing field, such as a soccer field, hockey field, football field, and skateboard ramp. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As noted above and depicted throughout FIGS. 1 through 19, the present invention is directed to convertible item that includes a pop-up element. The pop-up element allows the convertible item to be popped into or folded into a variety of instantaneous, pre-secured, configurations. The convertible item is any suitable item that is substantially planar or flat and that includes a pop-up element (e.g., it can be folded into a playing field). For example, the convertible item can be convertibly folded into a playing field, such as a soccer field, hockey field, football field, and skateboard ramp. As non-limiting examples, the convertible item can be a children's folder with traditional pockets or, alternatively, formed as a greeting card that one would give with a gift. In either case, the convertible item includes the appropriate flaps, cut-outs, fold lines, and/or perforations that allow it to be folded into the applicable playing field. As can be appreciated by one skilled in the art, any suitable substrate can be used to form the present invention, non-limiting examples of which include paper or thin pliable plastic. For example, the product is sold as a flat sheet of paper, card stock or pliable plastic containing a series of scores, tabs and slits that fold to form the playing field.

For further understanding, FIG. 1 is a die-line illustration of the shape, perforations, and cut-outs that collectively form a convertible item 100 (in this case, a children's folder) that can be folded into a playing field. As shown, the convertible item includes a bottom portion 102 that can be used to form pockets of the folder. Although one skilled in the art can appreciate that there are many techniques to form a pocket, one non-limiting example is to include a bottom portion 102 that can be folded up 104 and adhered to a back panel 106 to form the pockets.

Figure 2:
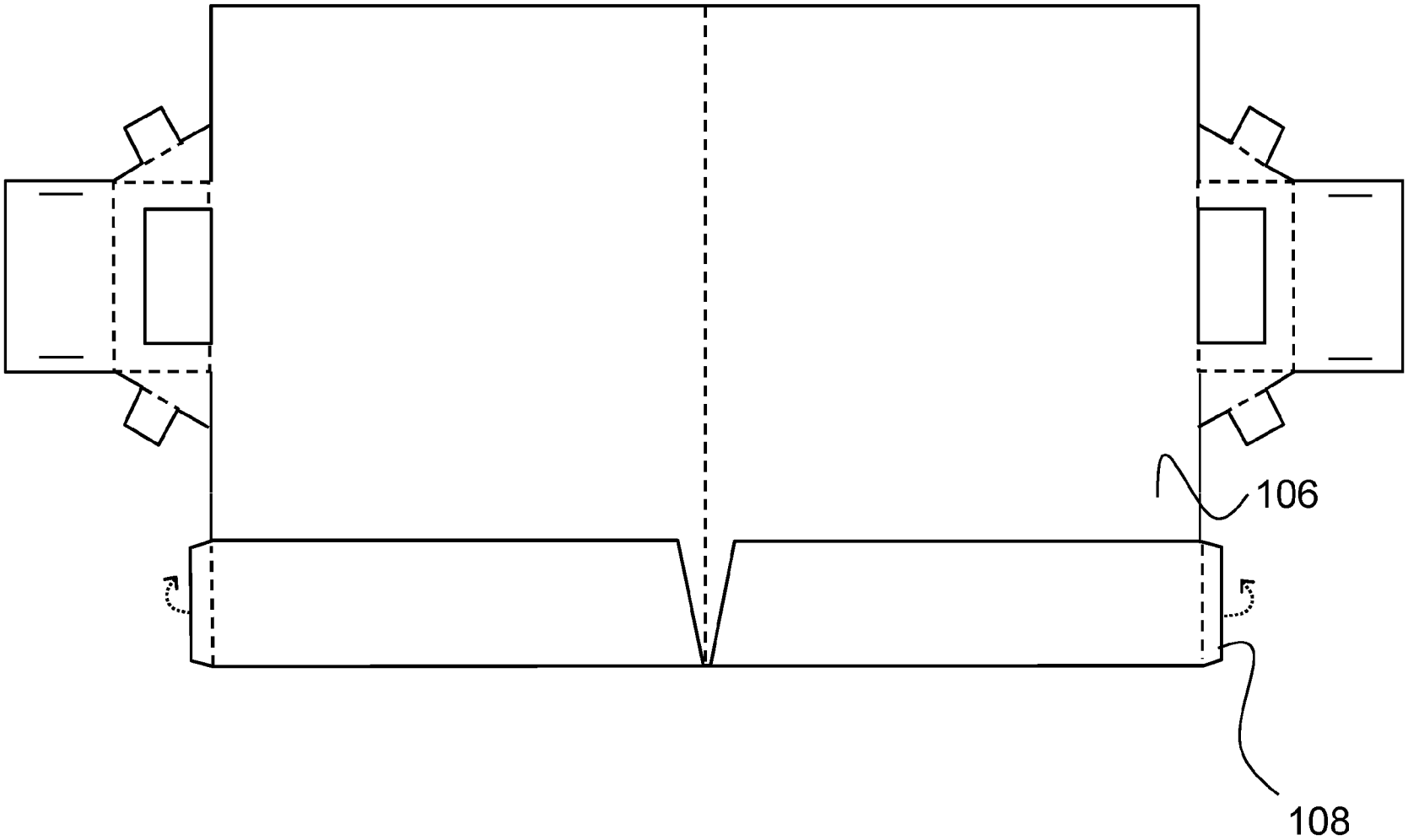
FIG. 2 is an illustration showing a bottom portion of the folder as folded up to form pockets, and further depicting wings of the pockets as being wrapped around the folder to fix the pockets.

For example and as depicted in FIG. 2, once the bottom portion 102 is folded up, wings 108 of the pockets can be wrapped around the back panel 106 or, alternatively, adhered to the face of the back panel 106. In either event, the wings 108 can be adhered or otherwise affixed to the back panel 106 to form the pockets (illustrated as element 110 in FIG. 3).

Figure 3:
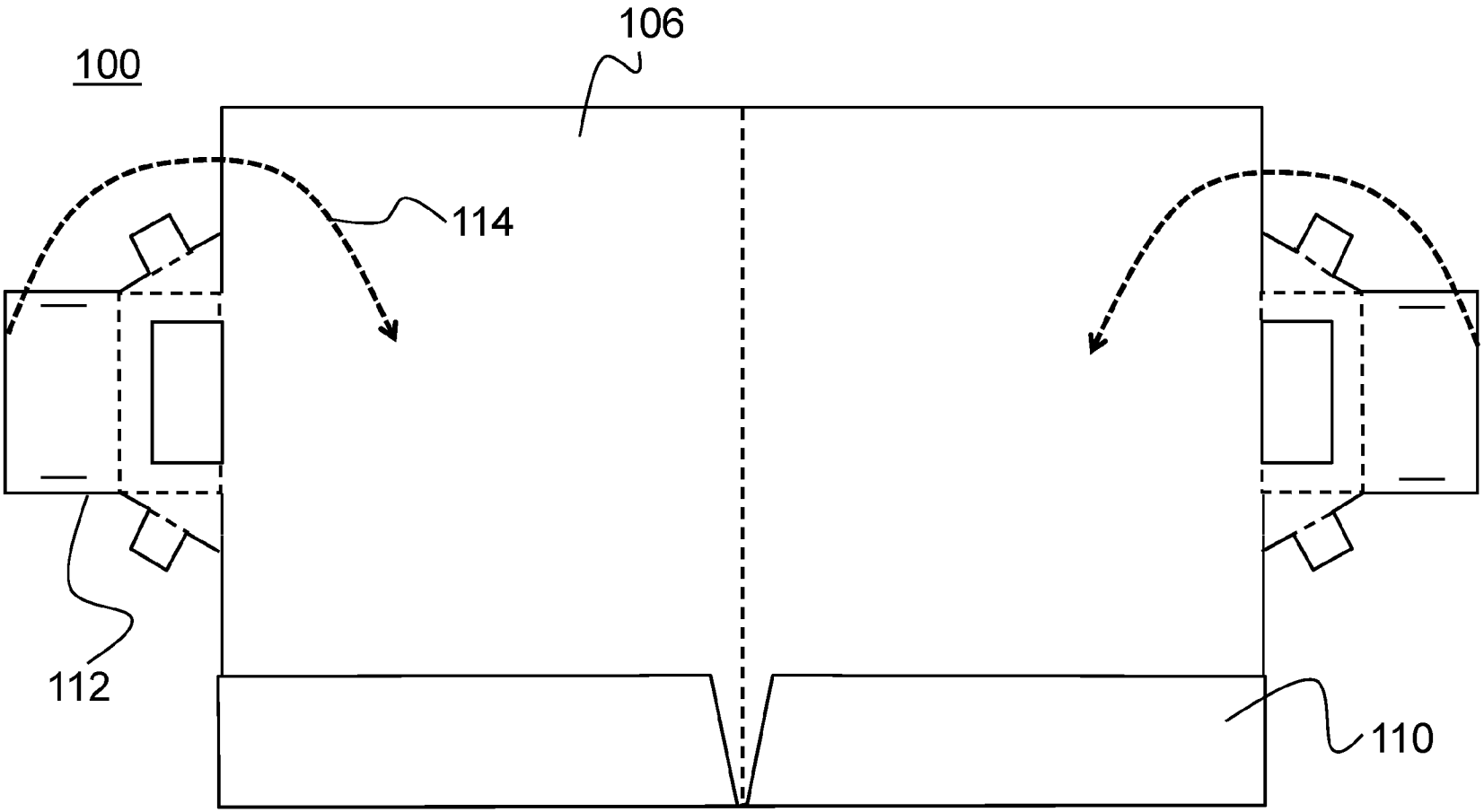
Figure 4:
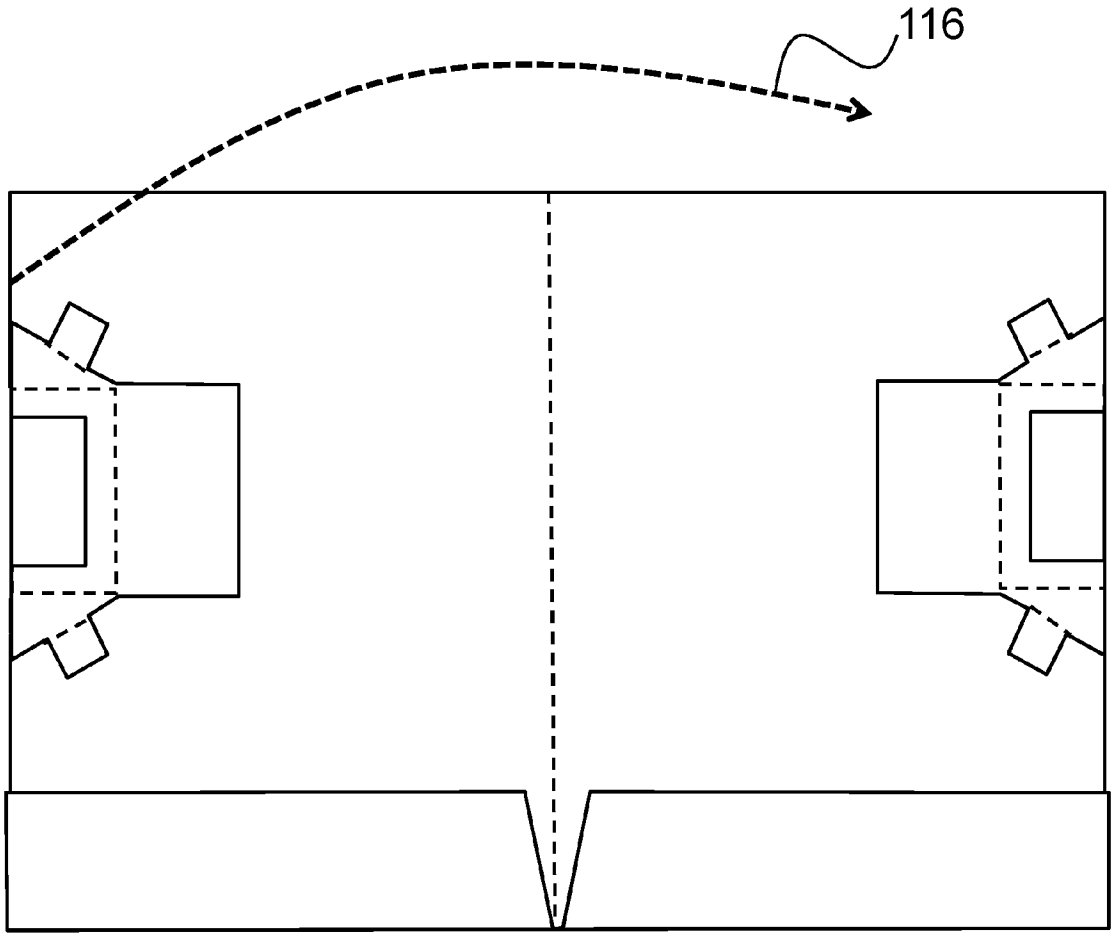
FIG. 4 is an illustration showing the goal portions folded in, and further depicting one half of the folder being folded onto the other.

Referring to FIG. 3, the pockets 110 are commonly included in folders and allow children or other uses to place paper and other items within the pocket 110 and, thereby, within the folder. As shown in FIG. 3, the convertible item 100 (folder in this example) also includes goal portions 112. The goal portion 112 is any suitable flap, cut-out, fold lines, and/or perforations that allow it to be folded into a goal to form the playing field. In the example depicted in FIG. 3, the goal portions 112, when folded into shape, form end goals that allow a player or players to hit miniature balls, pucks, etc., into the end goals. As shown, the goal portions 112 can be folded 114 against the back panel 106 to allow the folder to be folded shut (the folding action is depicted as element 116 in FIG. 4), with one half of the folder (i.e., the first half) being folded onto the other (i.e., the second half).

Figure 5:
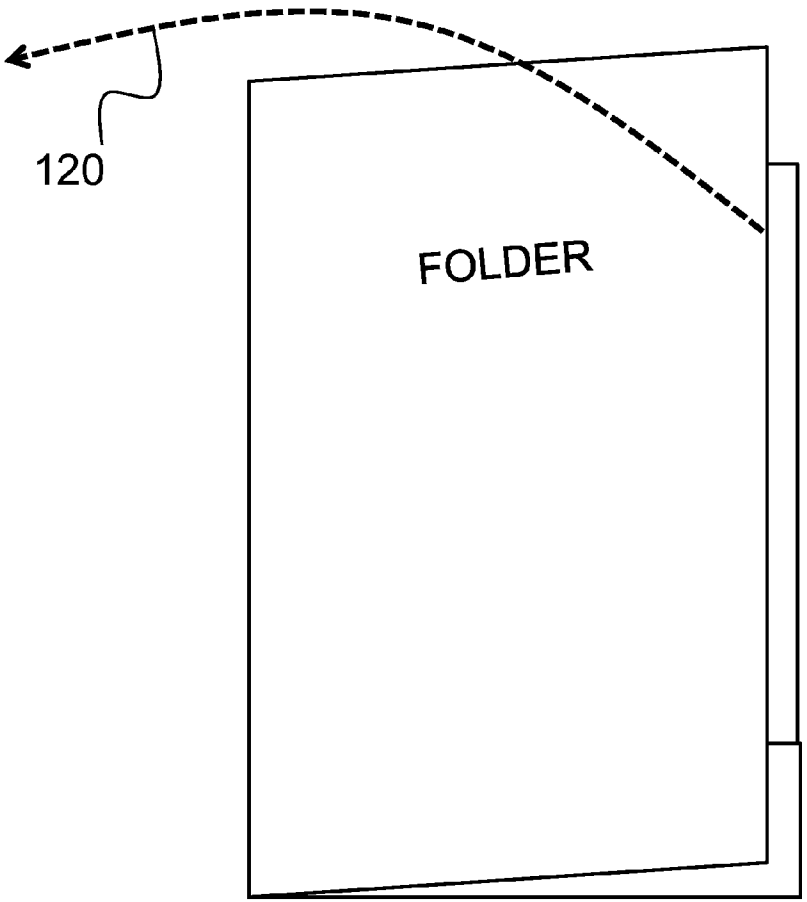
FIG. 5 is an illustration depicting a folder according to the present invention.

FIG. 5 illustrates a convertible item 100 according to the present invention. In one aspect as depicted, the convertible item 100 is a children's folder in a closed position. As evident throughout the figures, the convertible item 100 can be opened 120 to expose the playing field therein.

Figure 6:
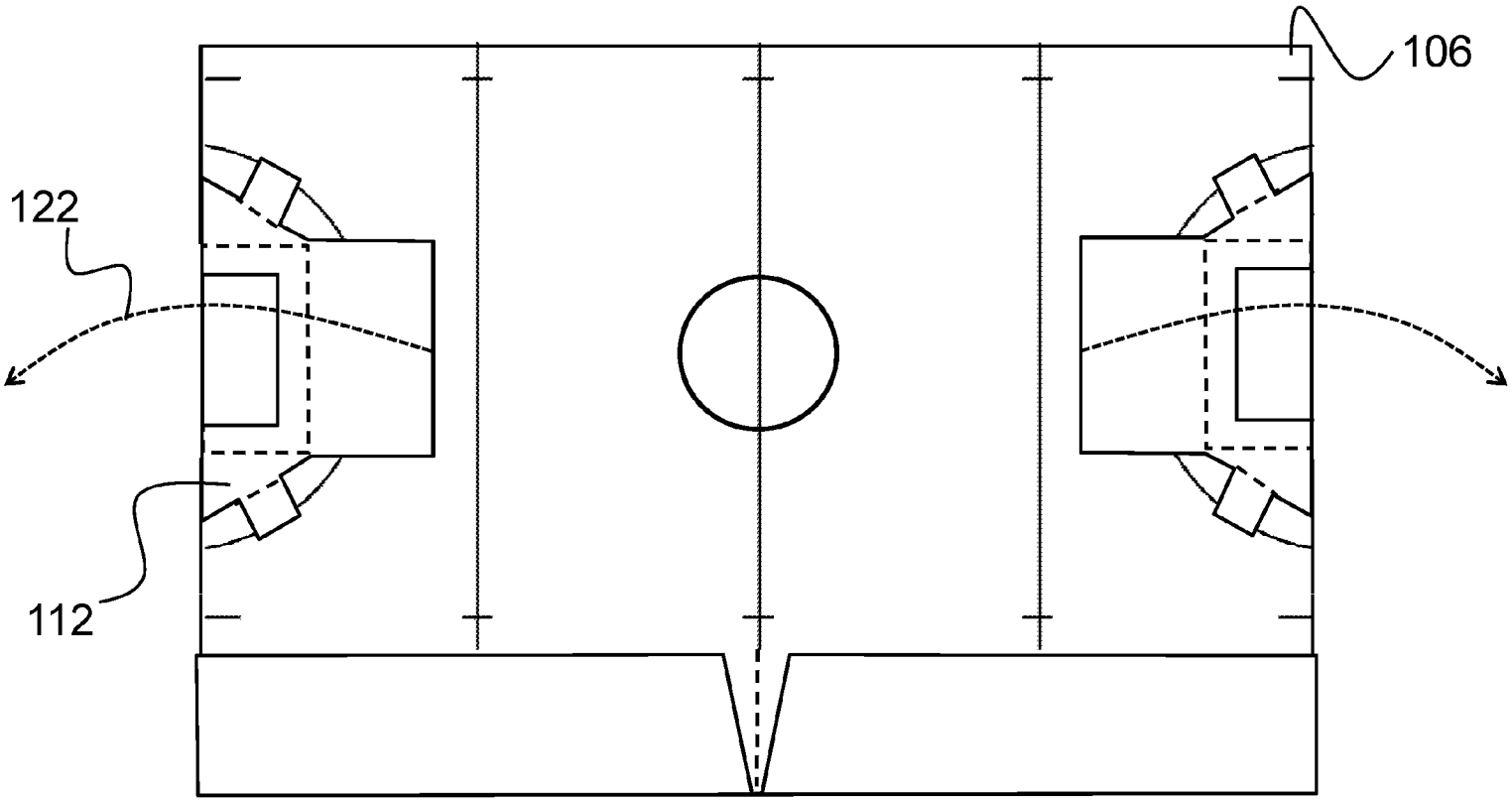
FIG. 6 is an illustration depicting the folder as opened, with playing field graphics printed thereon and depicting the goal portions as being folded out.
Figure 11:
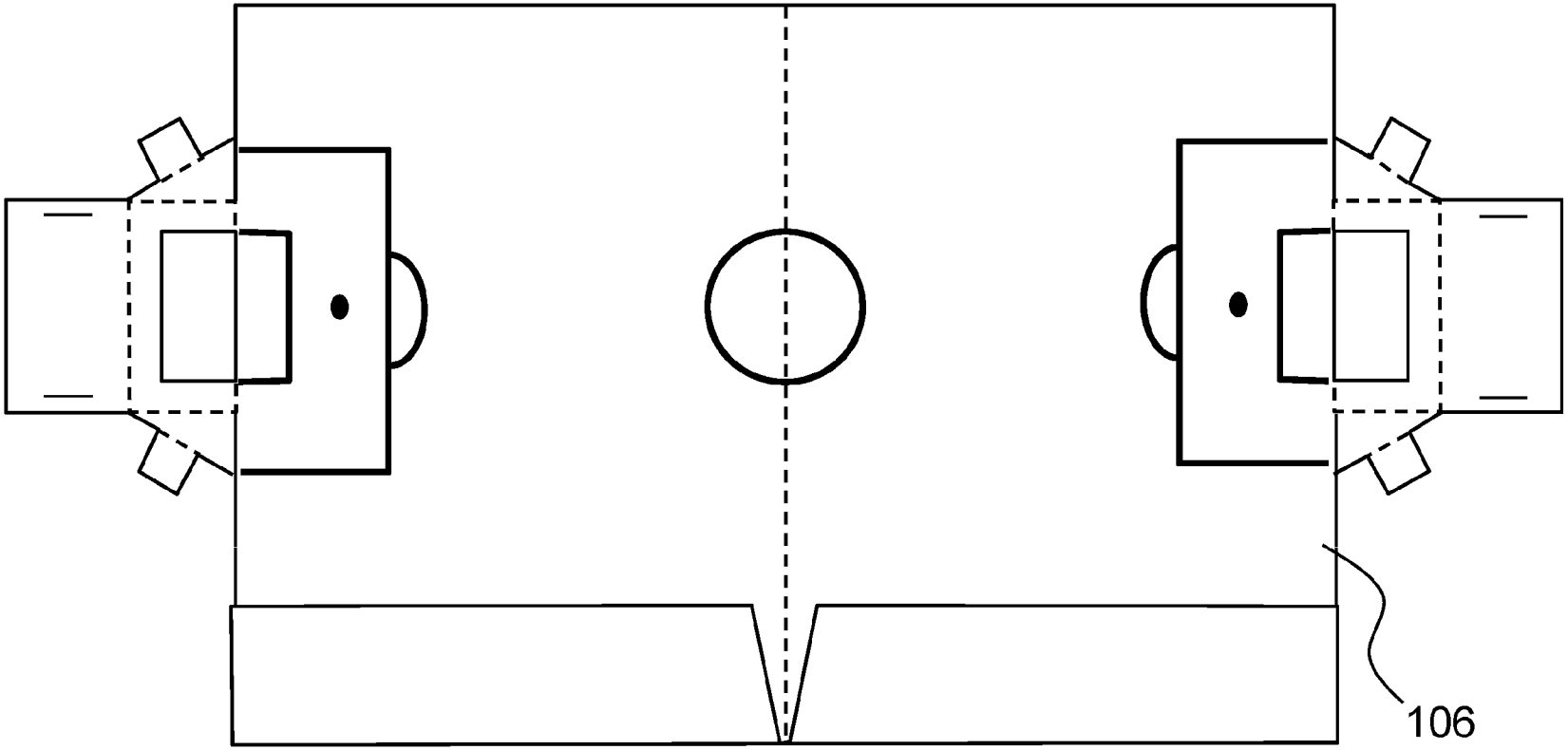
FIG. 11 is an illustration depicting the folder as opened and showing the playing field with alternative graphics printed thereon.
Figure 12:
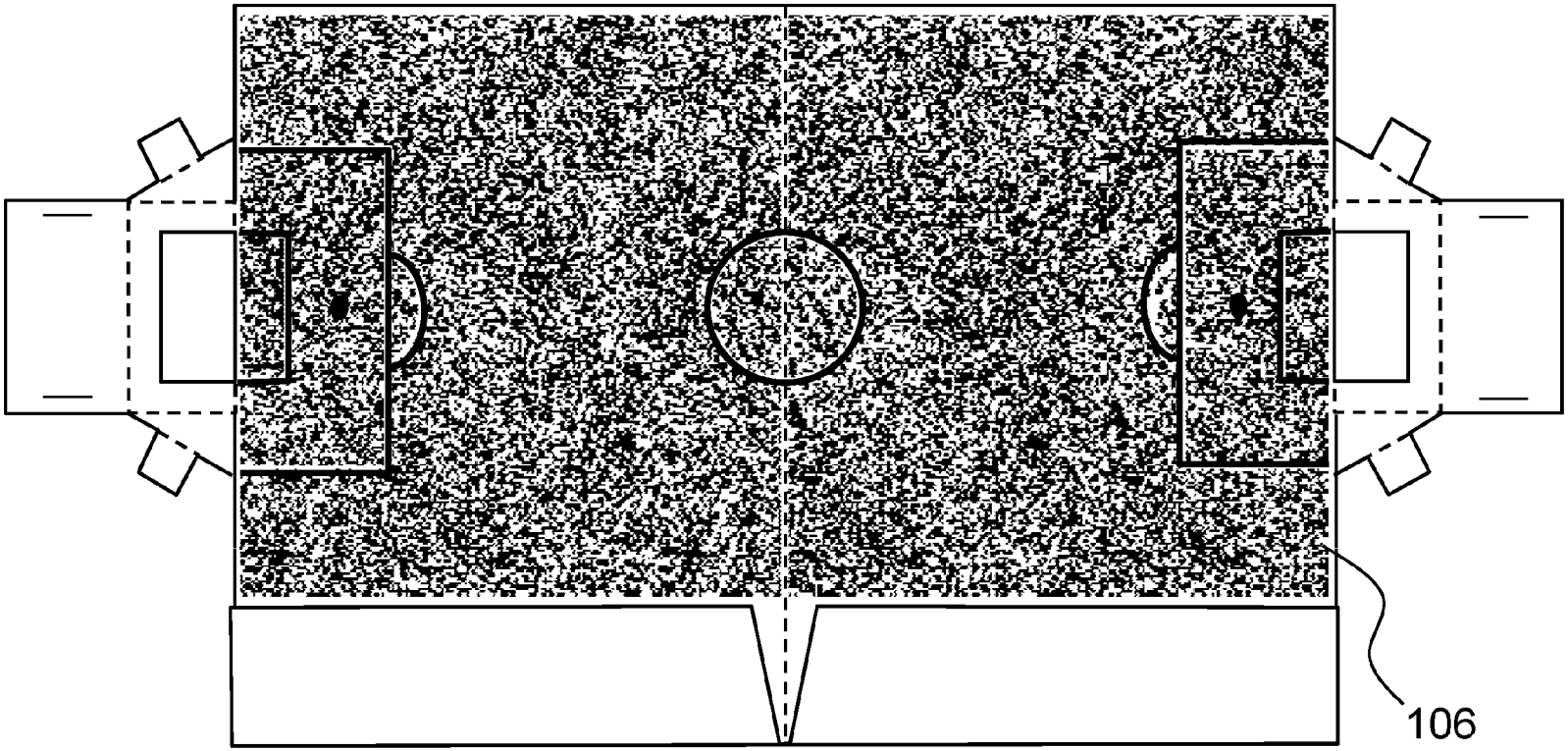
FIG. 12 is an illustration depicting the folder as opened and showing the playing field with alternative graphics printed thereon.

FIG. 6 is an illustration depicting the convertible item 100 (e.g., folder) as opened, with playing field graphics printed thereon. Although not required, the sheet can be imprinted with markings or images to further enhance the playing field qualities. As a non-limiting example and as depicted in FIGS. 6 through 10, the back panel 106 (or any other suitable portion and/or component) can be imprinted with a hockey playing field. Alternatively and as depicted in FIG. 11, the back panel 106 can be imprinted to mimic a soccer field, or, as depicted in FIG. 12, the back panel 106 can be imprinted with a grass pattern to further enhance its realism. It should be understood that the graphics or playing field aesthetics can be applied using any suitable technique, non-limiting examples of which include being imprinted, affixed (such as stickers), or 3D components that are folded out or otherwise adhered to the playing field.

Referring again to FIG. 6, a unique aspect of the present invention is that it doubles as a utilitarian item (such as a folder or card) that can be folded into a playing field. For example, although the convertible item works as a folder, it also includes goal portions 112 that can be folded out 122 and ultimately formed into a playing field with goals.

As can be understood by one skilled in the art, there are numerous ways by which the goal portions 112 or the playing field can be formed. Thus, although the figures and description describe a few specific examples, the present invention is not intended to be limited thereto as it is generally directed to a convertible item that is substantially flat or planar in a first state and that can be folded into a playing field in a second state.

Figure 7:
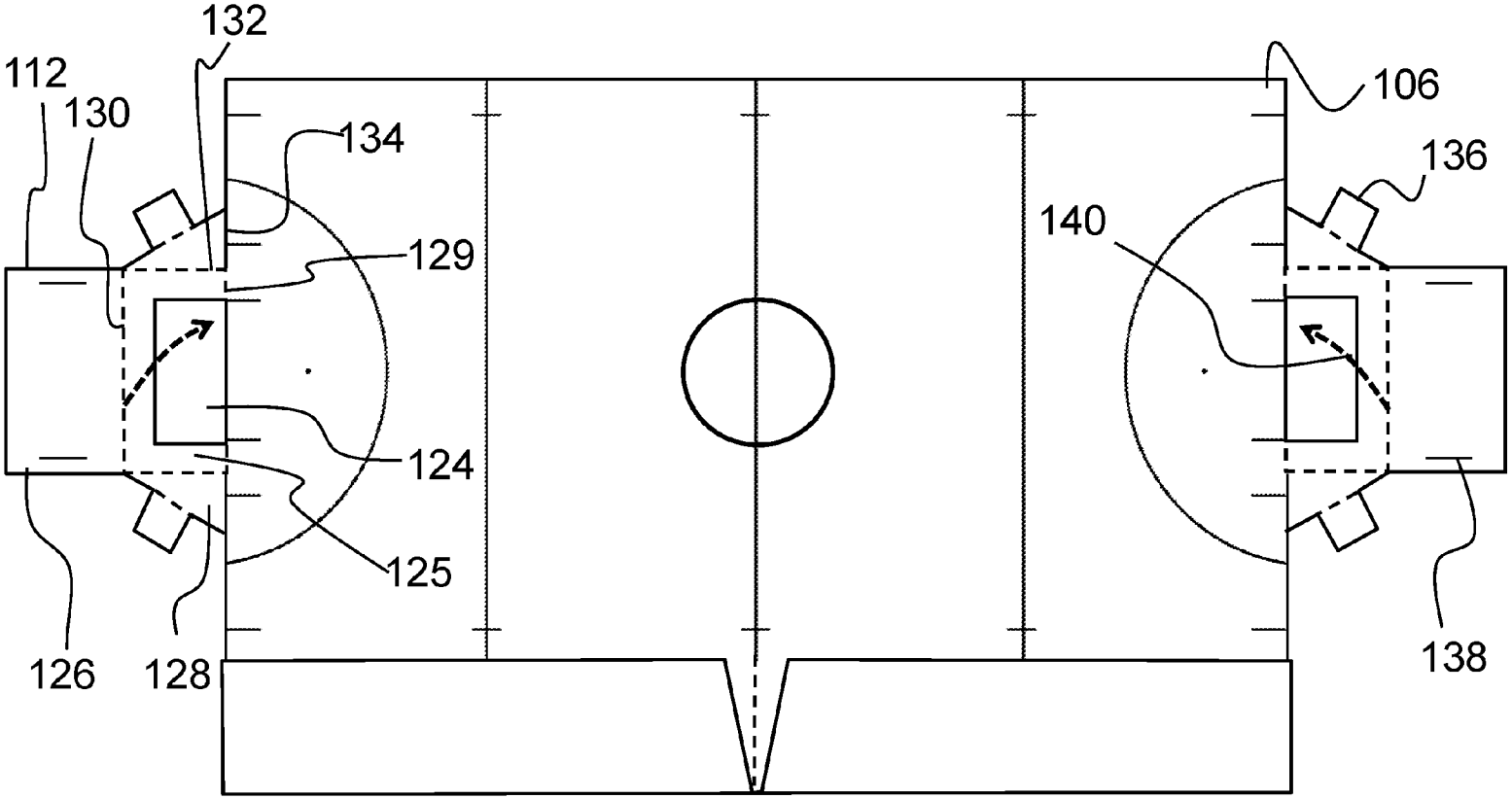
FIG. 7 is an illustration depicting the folder as opened, showing the goal portion being lifted up.

As shown in FIG. 7, after the goal portions 112 have been folded out, one can clearly see the goal portions 112 in this specific example. More specifically, each goal portion 112 includes a goal hole 124 that is die-cut or otherwise cut-out of a face 125 of the goal portion 112. The face 128 extends from the back panel 106 (or any other suitable piece of the convertible item) and is separated from the back panel 106 by a face fold-line 129. Further, a back support 126 and two side supports 128 are included. The back support 126 and side supports 128 are flaps that extend from the face 125 and are separated from the face 125 by a back fold-line 130 and side, fold-lines 132, respectively. Importantly and as will be understood later, each of the side supports 128 are connected with the face 125 via the side, fold-lines 132, while physically cut (via die-cut or otherwise separated) from the back panel 106 along a side cut-line 134. Finally, each goal portion 112 also includes side-support tabs 136 and back-support slits 138. It should be understood that the fold lines described herein are desirable as a way of separating connected components through a simple fold line that allows the connected components to be easily folded with respect to one another. The fold lines are creases, perforations, scores, or any other suitable marking or effect provided to two connected components to allow for rotation there-between. The process through which a user can fold the various components listed above to form an actual goal and playing field is described in further detail below.

Figure 8:
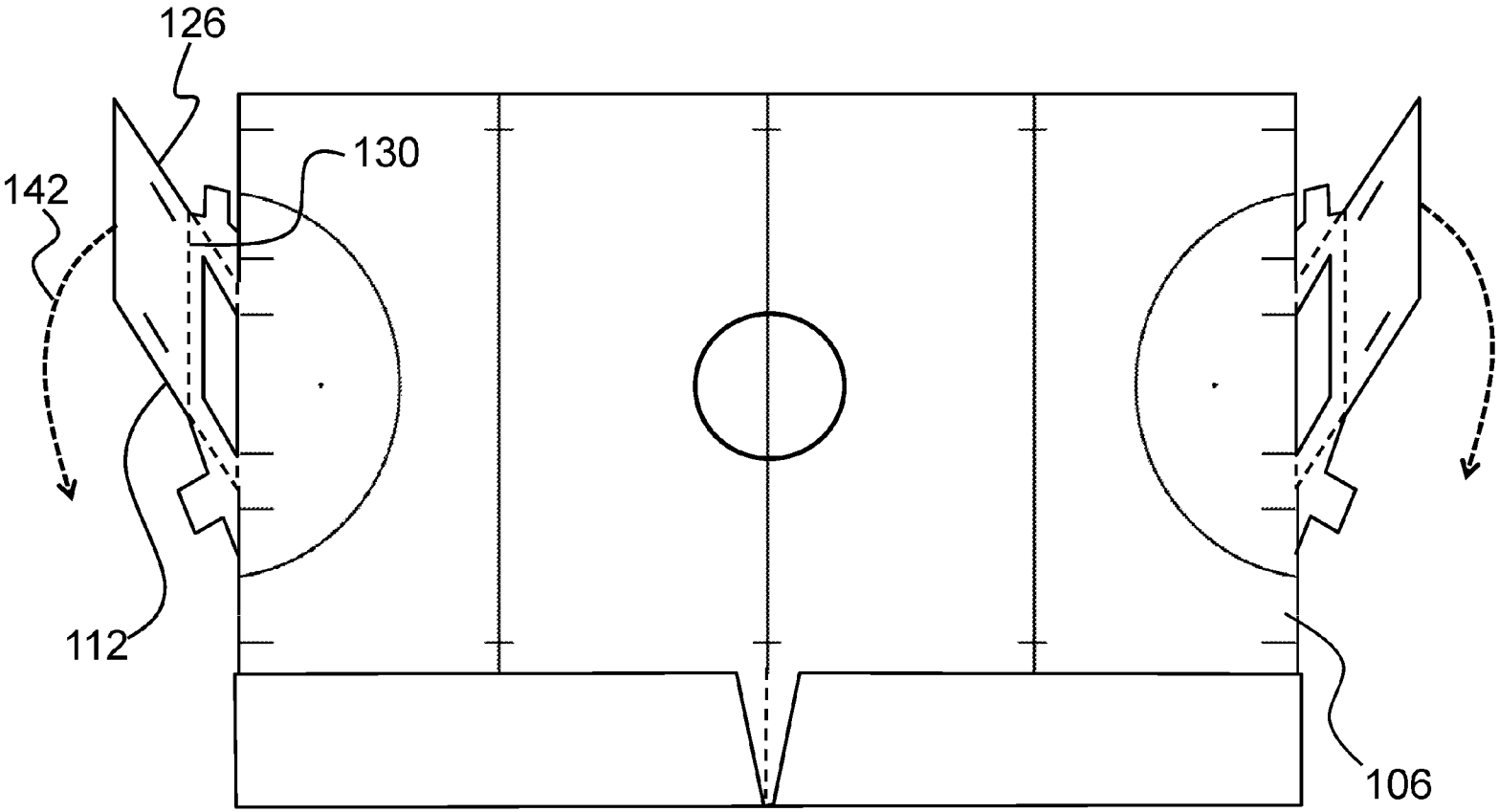
FIG. 8 is an illustration depicting the folder as opened, showing a back support of the goal portion being folded down.
Figure 9:
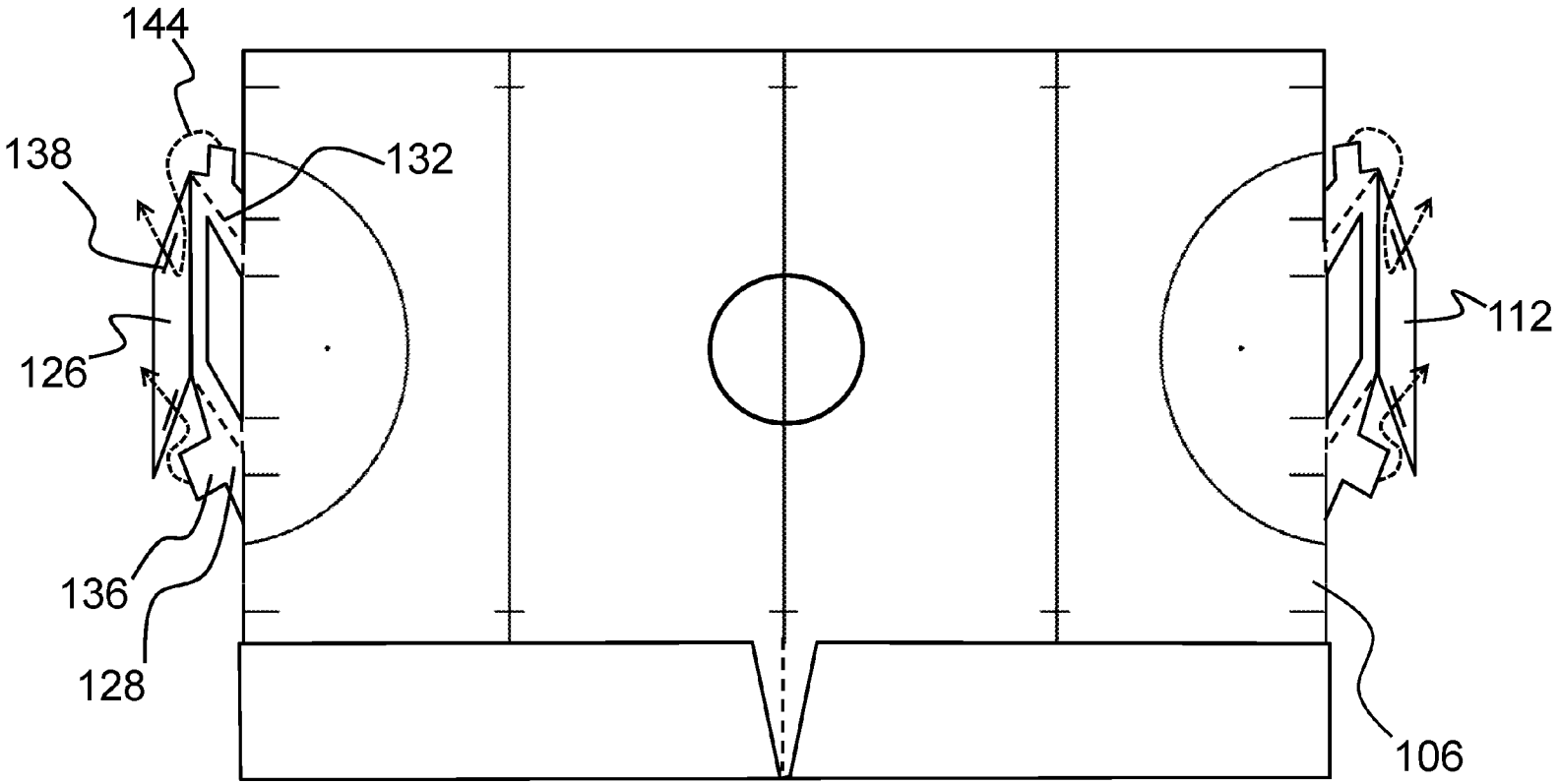
FIG. 9 is an illustration depicting the folder as opened, showing side supports of the goal portion being folded back to attach with the back support.

After the folder is opened and as shown in FIG. 7, the goal portion 112 is lifted up 140, bending along the face fold-line 129. Thereafter and as shown in FIG. 8, a back support 126 of the goal portion 112 is folded down 142, bending along the back fold-line 130.

Once the back support 126 is folded down, the side supports 128 are folded back 144 along the side, fold-lines 132. Further, the side-support tabs 136 can be positioned through the back-support slits 138 to affix the goal portion 112 into an upright position.

Figure 10:
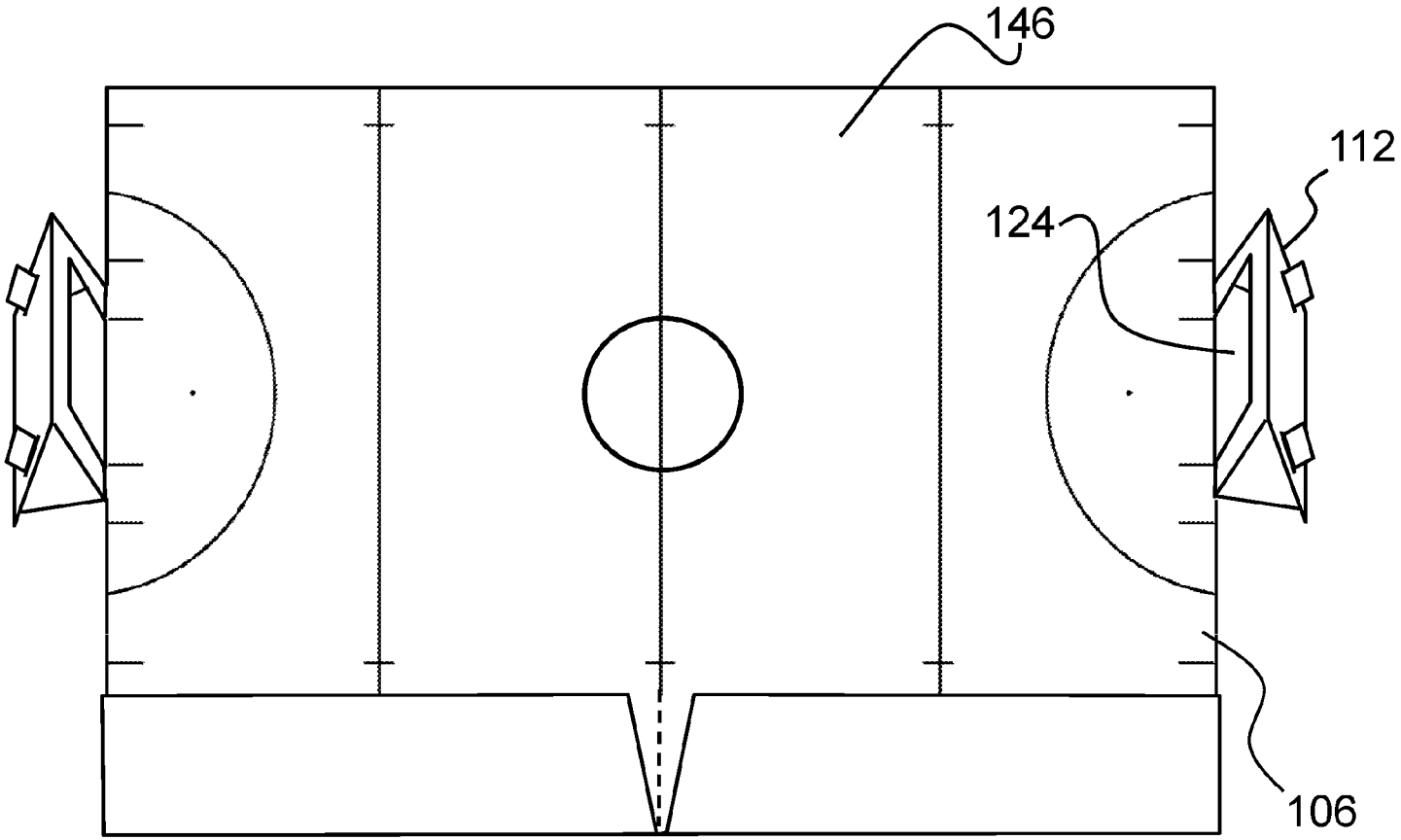
FIG. 10 is an illustration depicting the folder as opened and showing the playing field fully formed.

The final form of the playing field 146 is shown in FIG. 10, which depicts the folder in an open position, with goal portions 112 at each end of the playing field 146. Notably, the goal portions 112 are folded in such a way that the goal portions 112 are upright position, with goal holes 124 that each face the playing field 146. Thus, the goal portions 112 form end goals that allow a player or players to hit miniature balls, pucks, etc., into the end goals. As noted above, the goal portions 112 can be formed to represent a hockey field goal or soccer goal, or any other pop-up goal item (e.g., football field goals, etc.). It is usable for practice and play with small objects (erasers, marbles, spitballs, balls, pucks, etc.) being flicked in with fingers, pencils or other objects. In another aspect, tabs can be attached with item that can be pulled off and used as the small objects for shooting at the goals. For example, a triangle (or any other suitable shape) can be attached with an edge of the back panel, such that the triangle is folded into the folder when the folder is closed. Perforations are formed between the triangle and the back panel, allowing a user to easily rip the triangle from the back panel. Thus, in this aspect, the triangle can be used as a football to be flicked toward the pop-up goal item (e.g., football field goals).

As noted above, the present invention can be formed with any suitable indicia to depict any suitable playing field. For example and as shown in FIGS. 11 and 12, the back panel 106 can be formed with soccer field graphics (including a grass pattern as shown in FIG. 12).

Figure 13:
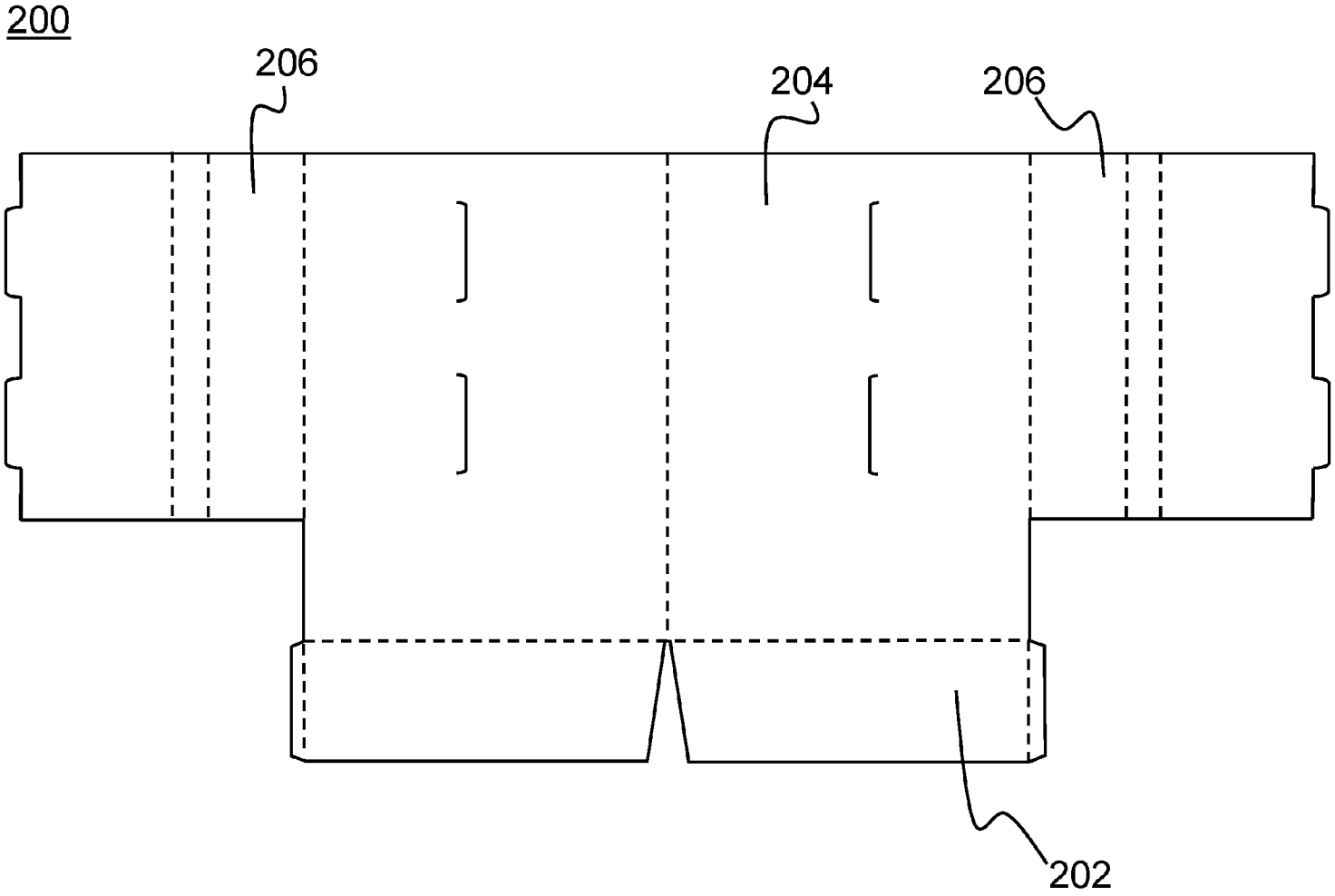
FIG. 13 is a die-line illustration of the shape, perforations, and cut-outs that collectively form a folder that can be folded into a playing field that operates as a half-pipe for miniature skateboards.

Also as noted above, the playing field can be formed to provide a variety of play patterns. For example and as depicted throughout FIGS. 13 through 17, the convertible item 200 is a folder that can be folded into a skateboard or bicycle ramp (i.e., half pipe). For further understanding, FIG. 13 is a die-line illustration of the shape, perforations, and cut-outs of a convertible item that collectively form a folder that can be folded into a half-pipe for miniature skateboards. As was the case above, the convertible item 200 includes a bottom portion 202 that can be used to form pockets of the folder. Also shown is a back panel 204 with ramp portions 206 that extend from each side of the back panel 204.

Figure 14:
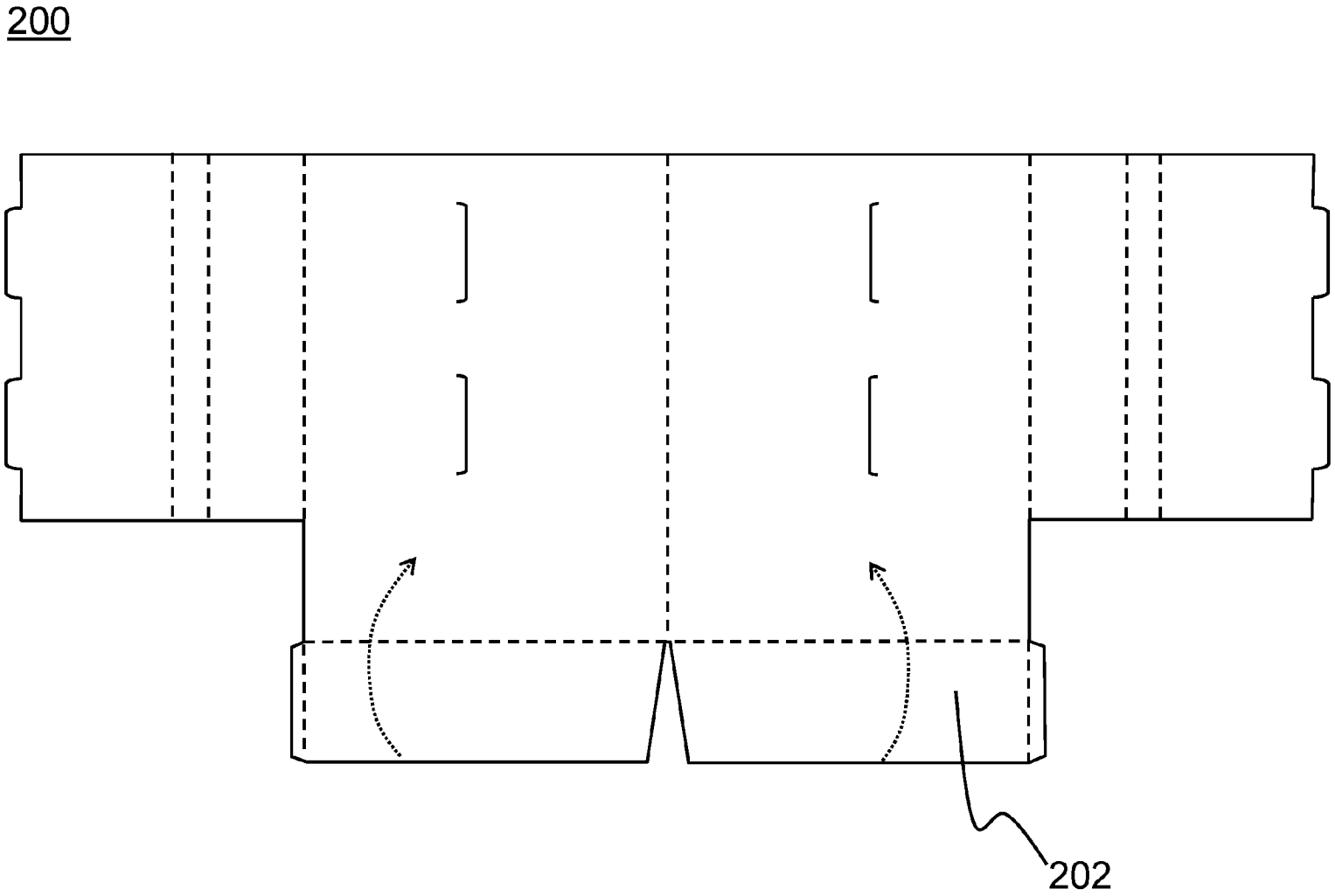
FIG. 14 is an illustration depicting a bottom portion of the folder as folded up to form pockets.
Figure 15:
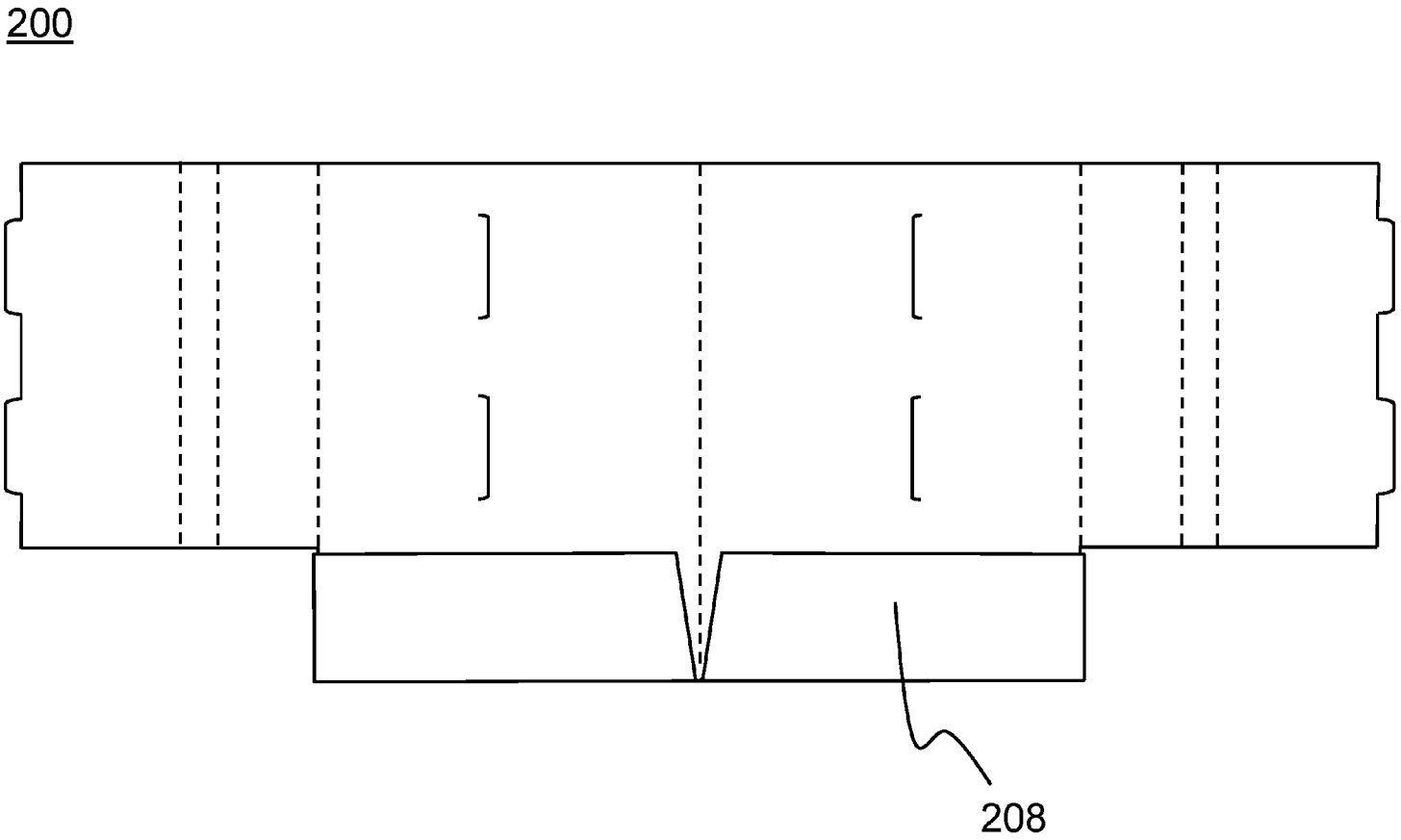
FIG. 15 is an illustration of the folder, depicting the ramp portions of the playing field.

FIG. 14 illustrates the bottom portion 202 being folded up to form the pocket of the folder. Further, FIG. 15 illustrates the folder as with the pocket formed 208 as described above. As noted above, the pocket 208 is not required; however, if present, it can be formed using any suitable method and is not limited to the technique described herein.

Figure 16:
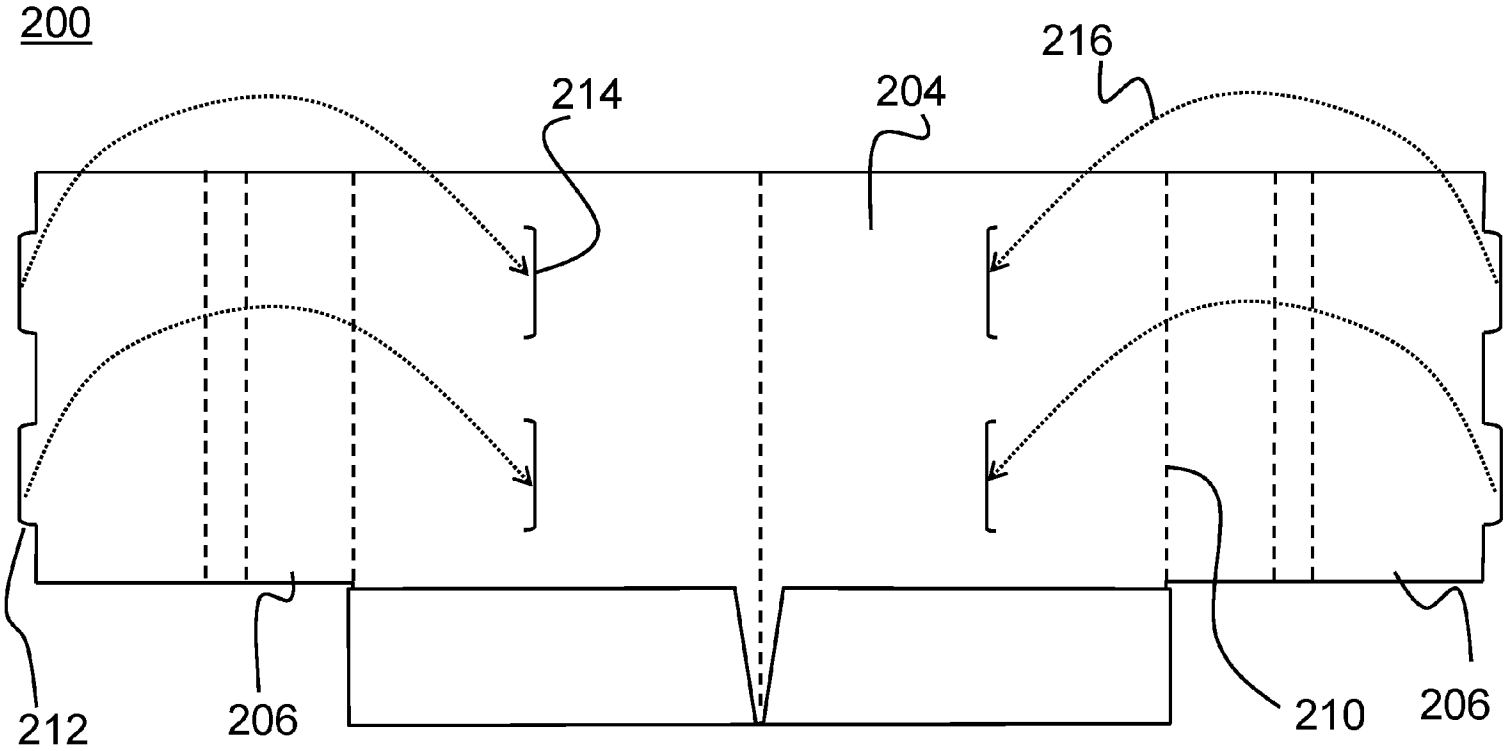
FIG. 16 is an illustration of the folder, depicting the ramp portions as folding into position to form the playing field ramp (i.e., half pipe)

FIG. 16 is an illustration of the folder, depicting a specific technique of forming the ramps, showing the ramp portions 206 as folding into position to form the playing field ramp (i.e., half pipe). It should be understood that the present invention is not limited to the specific technique described herein as any other suitable technique can be employed to form a pop-up ramp in conjunction with the convertible item described herein. With respect to the specific non-limiting example described herein, each ramp portion 206 is separated from the back panel 204 by a ramp fold-line 210. Further, each ramp portion 206 includes ramp tabs 212 that are formed to attach with ramp slits 214 (formed through the back panel 204).

Thus, as shown, each ramp portion 206 can be folded 216 and affixed with the corresponding ramp slits 214 to form the playing field ramp.

Figure 17:
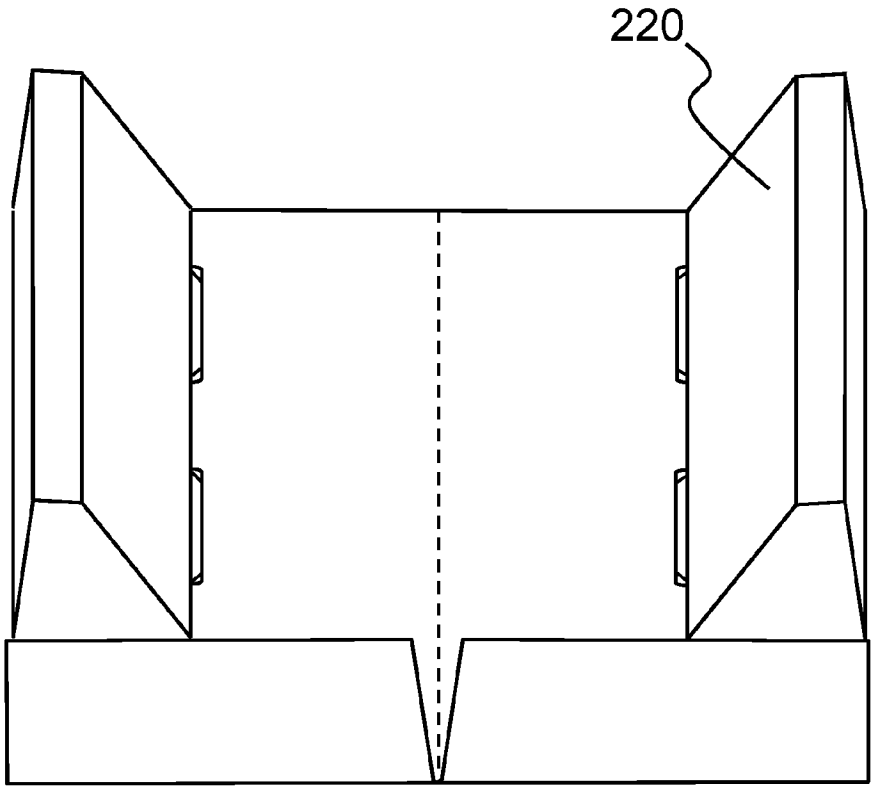
FIG. 17 is an illustration depicting the folder as opened and showing the playing field ramp as fully formed.

FIG. 17 illustration the folder as opened and showing the playing field ramp 220 as fully formed. Although not required, the item 200 (such as the back panel or faces of the ramp) can be imprinted with markings or images to further enhance the ramp-like qualities. As a non-limiting example, wood-grain images can be imprinted on the item 200 as appropriate so that once folded into the ramp, the ramp includes the appropriate wood-grain look to enhance its realism.

The ramp 220 is usable for practice and play by fingerboards, finger bikes etc. As can be appreciated by one skilled in the art, although the current images depict two ramps on either side, created to form a "Half-Pipe" when secured, the present invention is not intended to be limited thereto as additional ramp variations can be created. For example, additional ramp bodies can be provided on the top and/or bottom creating a "bowl" or other type of ramp configuration. Additionally, there can be several ramp bodies on a single side, forming varying and separate ramps with varying grades and widths on that (or any) single side.

As noted above and as depicted in FIGS. 18 and 19, the convertible item can be formed as a greeting card that one would give with a gift, while also including the appropriate flaps, cut-outs, fold lines, and/or perforations that allow it to be folded into the applicable playing field. A distinction between the items illustrated in FIGS. 1 through 17 and FIGS. 18 and 19, is that the original set of items include pockets that allow them to operate as folders, while the aspects depicted in FIGS. 18 and 19 do not include pockets.

Figure 18:
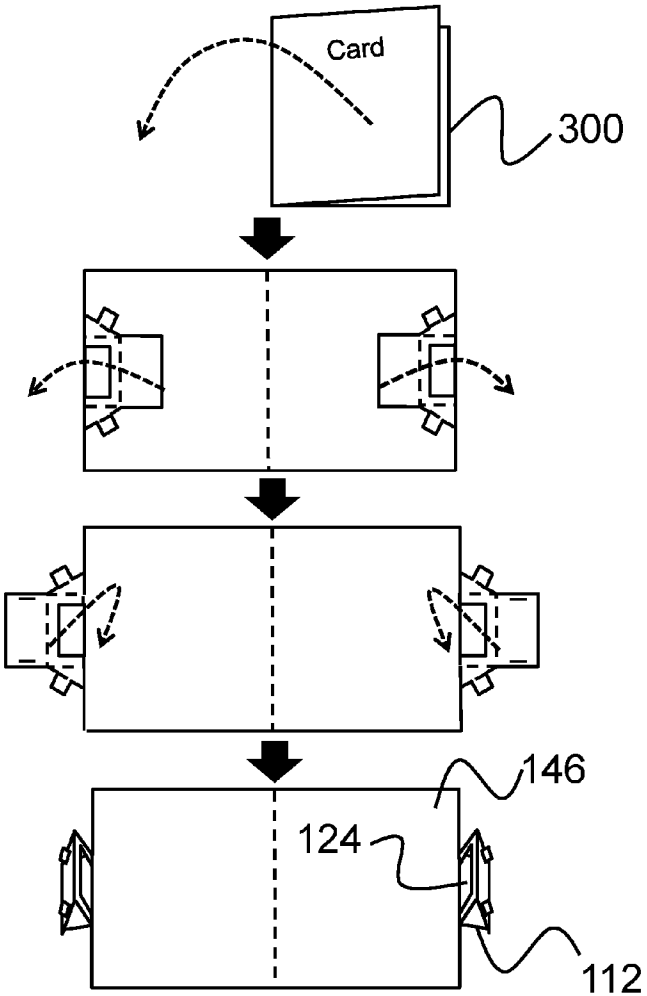
FIG. 18 is an illustration depicting the convertible item as a greeting card or other card-like item that can be folded into the playing field according to the present invention.
Figure 19:
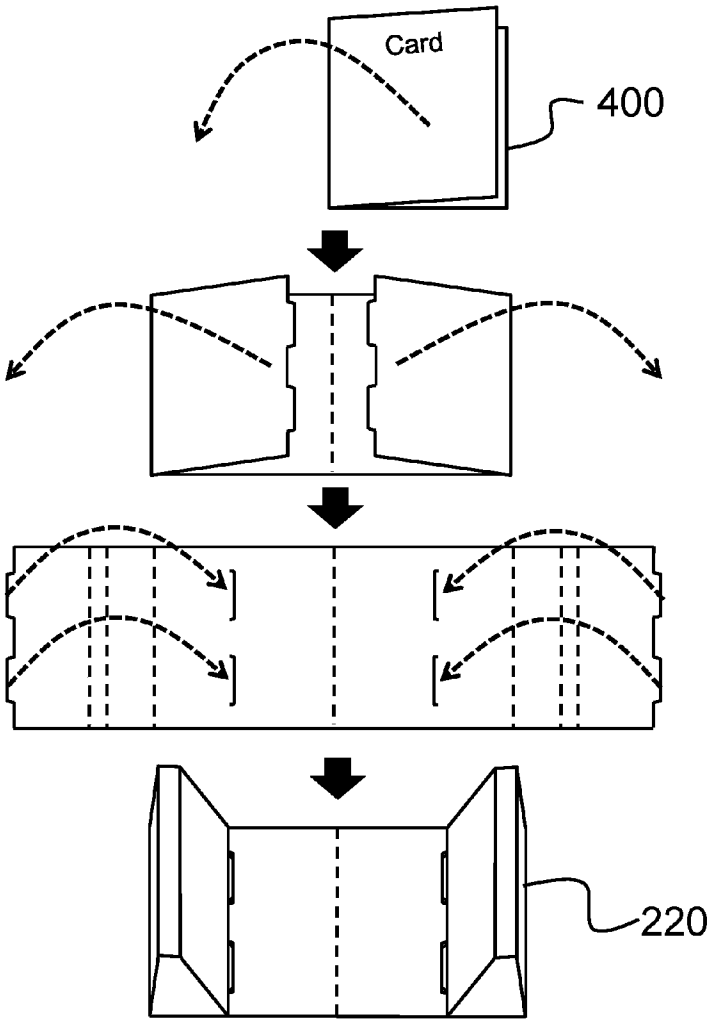
FIG. 19 is an illustration depicting the convertible item as a greeting card or other card-like item that can be folded into the playing field ramp according to the present invention.

For example, FIG. 18 is an illustration depicting the convertible item as a greeting card 300 or other card-like item that can be folded into the playing field according to the present invention. The final form of the playing field 146 is shown as being formed throughout FIG. 18, which depicts the greeting card 300 in an open position, with goal portions 112 at each end of the playing field 146. Notably, the goal portions 112 are folded in such a way that the goal portions 112 are upright position, with goal holes 124 that each face the playing field 146.

Another aspect is shown in FIG. 19, which again depicts the convertible item as a greeting card 400 or other card-like item. In this non-limiting example, the greeting card 400 is foldable into the playing field ramp 220 (using the same technique as described above).

What is claimed is:

1. A method for converting a folder from a folder configuration to a ramp configuration, comprising acts of;

opening a folder from a closed state to an open state, the folder having a substantially flat back panel with a first half and a second half, each of the first and second halves having a top portion and a bottom portion, wherein the bottom portion of each of the first and second halves includes a pocket affixed thereto, and wherein the top portion of each of the first and second halves includes a ramp portion extending therefrom, with a ramp fold line separating each ramp portion from the first or second half, wherein each ramp portion includes three sections delineated by fold lines, including a ramp side section, a ramp top section, and a ramp back section, with each ramp back section being connected with the first or second half along the ramp fold line, such that each ramp portion is foldable along the ramp fold line from a first state to a second state, wherein when in the first state, each ramp portion lays substantially flat against the first or second half, and when in the second state, each ramp side section is affixed against the first or second half such that the pockets remain uncovered by the ramp side sections and the ramp top sections are positioned substantially parallel with the first or second halves, with the ramp side sections facing one another to collectively form a ramp;

lifting each ramp portion along the fold line from the first state such that each ramp portion no longer lays substantially flat against the first or second half;

folding each ramp portion such that each ramp top section is elevated with respect to the first or second halves and substantially parallel with respect to the first and second halves, with the ramp side sections facing one another and inclined with respect to the first and second halves; and affixing each ramp side section against the first or second halves such that the pockets remain uncovered by the ramp section sections and each ramp top section is elevated with respect to the first or second halves and substantially parallel with respect to the first and second halves.

2. A method for converting a folder between a folder configuration and a ramp configuration, comprising acts of:

opening a folder from a closed state to an open state, the folder having a substantially flat back panel with a first half and a second half, each of the first and second halves having a top portion and a bottom portion, wherein the bottom portion of each of the first and second halves includes a pocket affixed thereto, and wherein the top portion of each of the first and second halves includes a ramp portion extending therefrom, with a ramp fold line separating each ramp portion from the first or second half, wherein each ramp portion includes three sections delineated by fold lines, including a ramp side section, a ramp top section, and a ramp hack section, with each ramp back section being connected with the first or second half along the ramp fold line, such that each ramp portion is foldable along the ramp fold line from a first state to a second state, wherein when in the first state, each ramp portion lays substantially flat against the first or second half, and when in the second state, each ramp side section is affixed against the first or second half such that the pockets remain uncovered by the ramp side sections and the ramp top sections are positioned substantially parallel with respect to the first or second halves, with the ramp side sections facing one another to collectively form a ramp;

lifting each ramp portion along the fold line from the first state such that each ramp portion no longer lays substantially flat against the first or second half;

folding each ramp portion such that each ramp top section is elevated with respect to the first or second halves and substantially parallel with respect to the first and second halves, with the ramp side sections facing one another and inclined with respect to the first and second halves; and affixing each ramp side section against the first or second halves such that the pockets remain uncovered by the ramp section sections and each ramp top section is elevated with respect to the first or second halves and substantially parallel with respect to the first and second halves;

releasing the ramp portions from the second state in which each ramp portion is affixed in an upright state against the first or second halves; and folding each ramp portion along the fold line to cause each ramp portion to lay substantially flat against the first or second half.

3. A convertible ramp folder, comprising:

a substantially flat back panel with a first half and a second half, each of the first and second halves having a top portion and a bottom portion;

wherein the bottom portion of each of the first and second halves includes a pocket affixed thereto;

wherein the top portion of each of the first and second halves includes a ramp portion extending therefrom, with a ramp fold line separating each ramp portion from the first or second half;

wherein each ramp portion includes three sections delineated by fold lines, including a ramp side section, a ramp top section, and a ramp back section, with each ramp back section being connected with the first or second half along the ramp fold line and each ramp side section having a ramp connector formed to affix with a corresponding back panel connector formed in the first or second halves;

wherein each ramp portion is foldable along the ramp fold line from a first state to a second state, such that when in the first state, each ramp portion lays substantially flat against the first or second half, and when in the second state, the ramp connector of each ramp side section is affixed against the corresponding hack panel connector formed in the first or second halves such that the pockets remain uncovered by the ramp side sections and the ramp top sections are positioned substantially parallel with the first or second halves, with the ramp side sections facing one another to collectively form a ramp.

4. The convertible ramp folder as set forth in claim 3, wherein each ramp connector is a ramp tab extending from the ramp side section, and wherein each back panel connector is a ramp slit formed in the first or second halves, such that when in the second state, the ramp tabs are aligned with and can be positioned through the ramp slits to affix each ramp portion in an upright state such that the ramp top sections are positioned substantially parallel with the first or second halves and the ramp side sections face one another to collectively form the ramp.

* * * * *